US005575579A

United States Patent [19]

Joulia

[11] Patent Number: 5,575,579

[45] Date of Patent: Nov. 19, 1996

[54] APPLICATOR EQUIPPED WITH A FLEXIBLE APPLICATION MEMBER AND ASSEMBLY COMPRISING SUCH AN APPLICATOR

[75] Inventor: Gérard Joulia, Paris, France

[73] Assignee: L'Oreal, Paris, France

[21] Appl. No.: 352,881

[22] Filed: Dec. 9, 1994

[30] Foreign Application Priority Data

Dec. 9, 1993 [FR] France ..... 93/14778

[51] Int. Cl.[6] ..... A46B 11/00

[52] U.S. Cl. ..... 401/119; 401/126; 401/129

[58] Field of Search ..... 401/4, 119, 126, 401/129, 130

[56] References Cited

U.S. PATENT DOCUMENTS

| | | | |
|---|---|---|---|
| 334,592 | 1/1886 | Leggett | 401/129 |
| 856,908 | 6/1907 | Peyton | 401/129 |
| 2,627,276 | 2/1953 | Eggleton | 401/129 M |
| 2,975,467 | 3/1961 | Stanzel . | |
| 4,498,490 | 2/1985 | Seidler . | |

FOREIGN PATENT DOCUMENTS

| | | | |
|---|---|---|---|
| 1150279 | 1/1958 | France | 401/4 |
| 2178647 | 2/1987 | United Kingdom . | |

*Primary Examiner*—Steven A. Bratlie
*Attorney, Agent, or Firm*—Staas & Halsey

[57] ABSTRACT

Fluid product applicator including a holder and a flexible application member connected thereto. A retainer, which acts by capillary effect, faces the member close to the end thereof which is connected to the holder. The retainer is flexible, its rigidity being similar to that of the member.

23 Claims, 1 Drawing Sheet

APPLICATOR EQUIPPED WITH A FLEXIBLE APPLICATION MEMBER AND ASSEMBLY COMPRISING SUCH AN APPLICATOR

SPECIFICATION

The present invention relates to an applicator equipped with a flexible application member and to an assembly comprising such an applicator.

BACKGROUND OF THE INVENTION

This applicator may especially be used for all liquid make-up products, such as blusher, concealer, eyeliner, nail varnish.

When such an applicator is being used, the application member is dipped in a reservoir, in which it becomes laden with product, then the product is deposited on the surface to be treated with the aid of the flexible member.

In such applicators known to date, the amount of product taken up by the application member allows in each dip a certain part of the surface to be treated to be covered; this amount is not always sufficient to carry out this application operation properly, as it is often necessary to dip the application member back in the reservoir several times.

In order to reduce the number of immersions of the application member in the reservoir, Patent Application GB-A-2 178 647 describes an applicator whose applicator brush passes through a reservoir chamber formed in the wand carrying the brush. The reservoir chamber is rigid and fills by capillary effect when the brush is soaking in the liquid. If the liquid, at rest, is not homogeneous, it is necessary to shake the application assembly. However, the product contained in the rigid reservoir chamber will be poorly homogenized relative to the product in which the applicator brush is soaking.

SUMMARY OF THE INVENTION

The subject of the present invention is an applicator of the sort described hereinabove, in which the application efficiency is increased, relative to that of the applicators known to date, the amount of product taken up in a single dip making it possible to treat a larger surface.

The subject of the invention is also an applicator allowing good homogenization of the product to be applied.

Thus, the subject of the present invention is a product applicator including an element for holding and a flexible application member, a retaining means with capillary effect being located facing the member close to its end via which it connects to the element for holding, wherein in that the retaining means is flexible, its rigidity being similar to that of the member.

The flexibility of the retaining member moreover allows the definition of a flexible reservoir chamber in which the product can be retained regardless of the level of the product contained in the reservoir.

It has also been observed that the flexibility of the retaining means, therefore that of the reservoir chamber, allows progressive release of product depending on the degree of bending of the applicator member, which progressiveness is not allowed by a rigid chamber of the prior art.

Advantageously, the retaining means surrounds the member; the retaining means and the member are coaxial in the position of rest of the applicator.

Advantageously, the flexible member is flexible transversely; preferably, the retaining means is also flexible transversely.

According to a preferred embodiment, the retaining means is an elastic element including of a filament wound like a spring, surrounding the member; the retaining means at one of its ends includes at least one positioning turn for fitting it onto the element for holding; the retaining means includes at least two non-contiguous retaining turns in which product is held by capillary effect; the retaining turns advantageously envelop an axisymmetric surface, for example of the spherical sort; the retaining means includes at least one end outflow turn.

Preferably, the element for holding constitutes a cap for a reservoir of the product; the cap includes a wand which, itself, carries the flexible member; the positioning turn of the retaining means is fitted around the said wand carried by the cap by elastic gripping.

In an advantageous embodiment, the member includes a set of bristles carried by the free end of the wand, the wand and the bristles constituting a brush.

It will have been noted that, by virtue of the invention, it is easy to convert an existing applicator with low efficiency into an applicator whose efficiency is increased, and to do so at low cost, because it is sufficient to fit the retaining means to an applicator of conventional type.

The invention advantageously applies to a nail varnish applicator.

The subject of the invention is also an assembly including a reservoir capable of containing a product to be applied and an applicator as defined previously.

BRIEF DESCRIPTION OF THE DRAWINGS

To make it easier to understand the subject matter of the invention, one embodiment thereof, represented in the appended drawings, will now be described by way of a purely illustrative and non-limiting example.

In these drawings.

DESCRIPTION OF THE PREFERRED EMBODIMENTS

Figure 1:
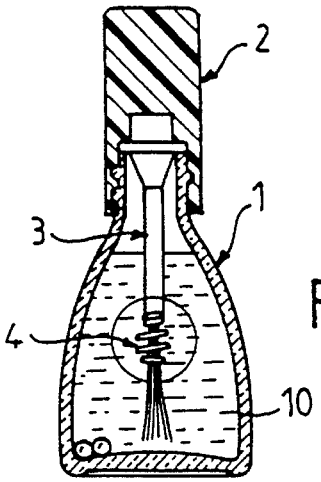
FIG. 1 shows, in section, an assembly comprising an applicator according to the invention.

Referring to the figures, the assembly according to the invention includes a reservoir 1, for example a glass bottle; or other container 1 containing a product 10 to be applied.

The assembly also comprises an applicator 2 which is composed of a cap 21 for closing the reservoir 1; for this purpose, the cap 21 includes internal screw threads 22 designed to interact with external screw threads 12 carried by the neck 11 of a reservoir 1.

The applicator 2 carries a wand 31 equipped at an end 34 there of with an application member 32; in the example represented, the member 32 includes bristles; the upper end, relative to the figures, of the wand 31 is extended by a part 33 having a larger diameter than the wand 31, and received in a corresponding housing of the cap 21 to which it is secured; the assembly including the wand 31 and the member 32 thus forms an application brush 3.

Figure 2:
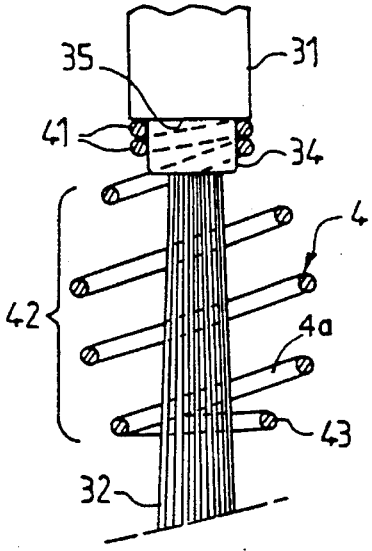
FIG. 2 is a view on a larger scale of the bubble in FIG. 1.

In accordance with the present invention, a fluid retaining means 4 using capillary effect is carried by the brush 3, more precisely by the end 34 of the wand 31; as is best visible in FIG. 2, the retaining means 4 is an elastic element including of a filament wound like a spring located around the member 32; such a retaining means 4 will hereafter be denoted as spring 4*a*; the spring 4 has two advantageously contiguous cylindrical turns 41 by means of which the spring 4*a* is fixed to the wand 31 by elastic gripping of the two contiguous cylindrical turns 41 around the end 34 of the wand 31. Here, cylindrical turns are understood to be turns inscribed inside a cylindrical surface. The end 34 of the wand 31 has a diameter slightly smaller than that portion of the wand 31 adjacent so as to define a transverse annular bearing surface 35 for axial positioning for the spring 4*a*.

The two cylindrical turns 41 are extended by four non-contiguous helical turns 42 and, in the example represented, the four turns 42 envelop an axisymmetric surface of the spherical sort, that is to say approximately spherical.

The four non-contiguous helical turns 42 are extended to a cylindrical outflow turn 43 whose role will become clear later.

In the position of rest of the applicator 2, which is the position represented in FIG. 2, the spring 4*a* has its axis longitudinal and coincident with the longitudinal axis of the wand 31, which is also the axis of symmetry of the set of bristles 32.

The spring 4*a* may be made of metal, for example stainless steel, or produced from a plastic.

The operation of the assembly according to the invention will now be described in the case of a dispensing assembly example in which the product 10 is a nail varnish.

Figure 3:
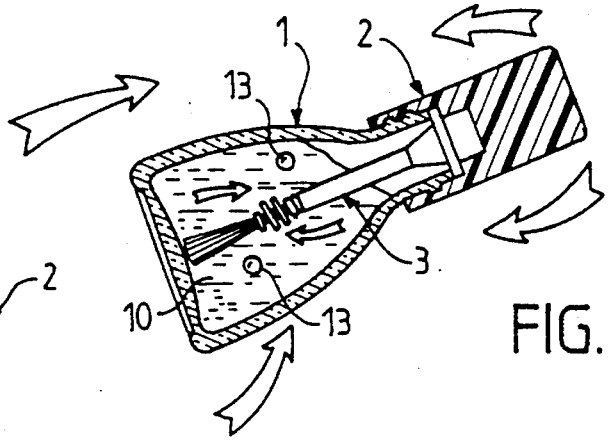
FIG. 3 is a view showing the assembly of FIG. 1 in its preliminary phase of use.

In the storage position, which is the position represented in FIG. 1, the spring 4*a* as well as the set of bristles of member 32 of the brush 3 of the applicator 2 are immersed in the nail varnish 10. Before removing the cap from the reservoir 1, the user shakes the assembly, as illustrated in FIG. 3; this operation makes it possible, on the one hand, by virtue of the presence in the reservoir 1 of stainless steel balls 13, to homogenize the nail varnish 10 and, on the other hand, to exchange nail varnish contained in the internal volume of the spring 4*a* for nail varnish 10 which is then homogenized by the user in the reservoir 1 during this phase.

Figure 4:
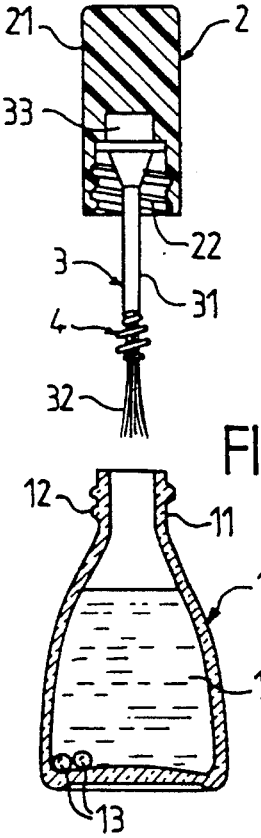
FIG. 4 shows the assembly of FIG. 1, the applicator having been separated from the reservoir.

Next, of course, the user removes the cap from the reservoir 1, as FIG. 4 shows: during this operation, the applicator 2 entrains with it some nail varnish 10 retained not only in the bristles of the member 32 of the brush 3 but also some nail varnish 10 contained inside the spring 4*a* where it is retained by a capillary effect.

At the beginning of the application of the bristles of the member 32 of a brush 3 to the nail 7, the bristles of the member 32, while being in contact with the nail, remain aligned with the axis common to the wand 31 and to the spring 4*a*, and the varnish deposited on the nail is that which comes from the bristles of the member 32, the spring 4*a* retaining its varnish, the conditions for capillary effect being preserved.

Figure 5:
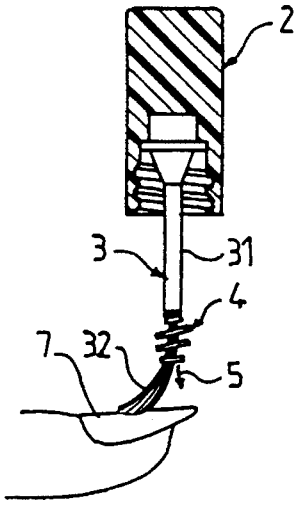
FIGS. 5 and 6 show the applicator according to the invention in use, wherein the product contained in the reservoir is a nail varnish.
Figure 6:
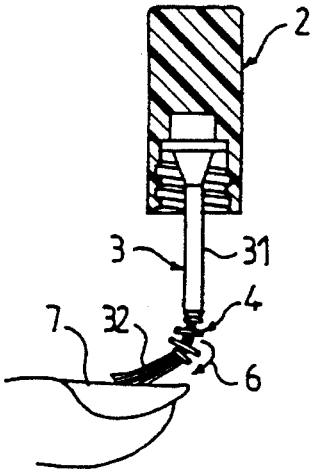

After the varnish contained in the bristle of the member 32 of the brush 3 have been used up, a force on the applicator 2 makes the bristles of the member 32 assume a certain curvature, as shown in FIG. 5: in this position, the bristles of the member 32 are sufficiently off-centered relative to the outflow turn 43 for the conditions for capillary effect to be interrupted owing to this eccentricity, at least for the first turn closest to the nail 7; some varnish contained in the spring 4*a* then flows out along the bristles of the member 32 which it feeds, as is illustrated by the arrow 5 in the figure. Continuing, through action on the applicator 2, to bend the bristles of the member 32 further onto the nail 7, as shown for example in FIG. 6, the turns 42 become off-centered in succession relative to the bristles of the member 32 of the brush 3 and thus the spring 4*a* is progressively drained, as is illustrated by the arrow 6 in the figure.

As can be seen, the spring 4*a* makes it possible to increase the fluid application efficiency of the brush 3: tests have shown that whereas a conventional brush soaked just once in the reservoir 1 allows just two nails approximately to be painted, the assembly according to the invention, provided with the retaining means 4, makes it possible, under the same conditions, to paint approximately five nails.

It will have been noted that the retaining means 4 according to the invention is simple, of relatively low retail price, and that it can be fitted to a conventional brush 3 without modifying the latter.

As has been seen, the outflow of the varnish 10 coming from the retaining means 4, for feeding the bristles of the member 32 with varnish 10, is a function of the relative transverse position of the retaining means 4 relative to the applicator 3. Its operation depends on the viscosity of the product, on the radial clearance between the turns of the spring 4*a* and the brush 3, as well as on the flexibility of the spring 4*a*; as the bristles of the member 32 of the brush 3 are also flexible, it is necessary for the flexibility of the spring 4 to be similar to that of the bristles of the member 32 so that the bristles of the member 32, in deforming, entrain the deformation of the spring 4*a*, and therefore bring the spring 4*a* into action as a means for retaining product for feeding the application member with additional product.

I claim:

1. Product applicator movable between a rest position and a use position, comprising:

a holder;

a flexible application member connected to the holder; and a retainer located facing the member close to an end via which the member connects to the holder;

wherein the retainer is flexible, retains fluid by capillary effect, has a flexibility that is similar to a flexibility of the member, and is separated from the application member in the rest position, and wherein, when the application member is bent in the use position, the retainer is bent, the application member and the retainer contact each other, so that the application member, in the use position, is supplied with fluid from the flexible retainer.

2. Applicator according to claim 1, wherein the retainer surrounds the member.

3. Applicator according to claim 2, wherein the retainer and the member are coaxial in the rest position of the applicator.

4. Applicator according to claim 1, wherein the retainer is an elastic element including a filament wound like a spring, surrounding the member.

5. Applicator according to claim 4, wherein the retainer includes at least one positioning turn for fitting the retainer to the holder.

6. Applicator according to claim 5, wherein the positioning turn is fitted, by elastic gripping, around a wand carried by the holder.

7. Applicator according to claim 4, wherein the retainer includes at least two non-contiguous retaining turns.

8. Applicator according to claim 7, wherein the retainer defines an axisymmetric surface.

9. Applicator according to claim 4, wherein the retainer includes at least one end outflow turn.

10. Applicator according to claim 1, wherein the holder is a cap for a reservoir of the product.

11. Applicator according to claim 10, wherein the cap carries a wand which carries the member.

12. Applicator according to claim 1, wherein the member includes a set of bristles carried by a free end of a wand.

13. Assembly, comprising:

a reservoir for containing a product to be applied; and an applicator movable between a rest position attached to the reservoir and a use position outside of and removed from the reservoir, and including a holder, a flexible application member connected to the holder; and a retainer located facing the member close to an end via which the member connects to the holder, wherein the retainer is flexible, retains fluid by capillary effect, has a flexibility that is similar to a flexibility of the member, and is separated from the application member in the rest position, and wherein, when the application member is bent in the use position, the retainer is bent, the application member and the retainer contact each other, so that the application member, in the use position, is supplied with fluid from the flexible retainer.

14. Assembly according to claim 13, wherein the retainer surrounds the member.

15. Assembly according to claim 14, wherein the retainer and the member are coaxial in the rest position of the applicator.

16. Assembly according to claim 13, wherein the retainer is an elastic element including a filament wound like a spring, surrounding the member.

17. Assembly according to claim 16, wherein the retainer includes at least one positioning turn for fitting the retainer to the holder, at least two non-contiguous retaining turns, and at least one end outflow turn.

18. Assembly according to claim 17, wherein the positioning turn is fitted, by elastic gripping, around a wand carried by the holder.

19. Assembly according to claim 13, wherein the retainer defines an axisymmetric surface.

20. Assembly according to claim 13, wherein the holder is a cap for the reservoir.

21. Assembly according to claim 20, wherein the cap carries a wand which carries the member.

22. Assembly according to claim 13, wherein the member includes a set of bristles carried by a free end of a wand.

23. Assembly according to claim 13, wherein the product to be applied is a nail varnish.

* * * * *